US005349788A

United States Patent [19]

Nedo et al.

[11] Patent Number: 5,349,788

[45] Date of Patent: Sep. 27, 1994

[54] APPARATUS FOR CATCHING RESIDUAL WATER JET IN WATER JET CUTTING APPARATUS

[75] Inventors: Werner Nedo, Bautzen; Harry Thonig, Neukirch; Mathias Walden, Sohland, all of Fed. Rep. of Germany

[73] Assignee: Saechsishe Werkzeug und Sondermaschinen GmbH, Neukirch, Fed. Rep. of Germany

[21] Appl. No.: 136,544

[22] Filed: Oct. 14, 1993

[30] Foreign Application Priority Data

Oct. 17, 1992 [DE] Fed. Rep. of Germany ..... 4235090

[51] Int. Cl.[5] ..... B24C 3/04; B24C 9/00

[52] U.S. Cl. ..... 451/75; 451/88

[58] Field of Search ..... 51/321, 410, 424, 425, 51/439; 83/53, 177

[56] References Cited

U.S. PATENT DOCUMENTS

| | | | |
|---|---|---|---|
| 532,374 | 1/1895 | Hermes . | |
| 2,732,040 | 1/1956 | De Vost et al. . | |
| 2,985,050 | 5/1961 | Schwacha . | |
| 3,212,378 | 10/1965 | Rice . | |
| 3,637,051 | 1/1972 | Paine et al. . | |
| 3,730,040 | 5/1973 | Chadwick | 83/177 |
| 3,877,334 | 4/1975 | Gerber | 83/177 |
| 3,978,748 | 9/1976 | Leslie et al. | 83/53 |
| 4,112,797 | 9/1978 | Pearl . | |
| 4,137,804 | 2/1979 | Gerber et al. | 83/177 |
| 4,463,639 | 8/1984 | Gerber | 83/177 |
| 4,501,182 | 2/1985 | Jardat et al. . | |
| 4,651,476 | 3/1987 | Marx et al. . | |
| 4,669,229 | 6/1987 | Ehlbeck . | |
| 4,728,379 | 3/1988 | Audi et al. | 83/53 |
| 4,867,780 | 9/1989 | Ehlbeck et al. . | |
| 4,872,293 | 10/1989 | Yasukawa et al. | 51/424 |
| 4,872,975 | 10/1989 | Benson | 51/424 |
| 4,964,244 | 10/1990 | Ehlbeck . | |
| 5,083,487 | 1/1992 | Croteau | 83/29 |
| 5,127,199 | 7/1992 | Blankers et al. | 51/425 |

FOREIGN PATENT DOCUMENTS

| | | |
|---|---|---|
| 0270364 | 6/1988 | European Pat. Off. . |
| 0480118 | 4/1992 | European Pat. Off. . |
| 1216799 | 8/1989 | Japan . |

*Primary Examiner*—Robert A. Rose

[57] ABSTRACT

A water jet cutting apparatus has a line catcher for water and abrasive passing through the worktable comprising a carriage on the frame is movable above a pervious worktable and carries a water jet cutting head. A pan ia supported on the frame and spaced below the worktable, and a collector extends transversely of the frame between the worktable and pan for movement along the length of the worktable in alignment with the cutting head, and has a drain. An insert member is supported in the collector and drains into the collector. A settling tank cooperates with a sludge pump with a conduit from the pan to the settling tank to transport water and abrasive material to the tank. A rinsing pump has a conduit from the settling tank to the collector to draw water from the settling tank and flush abrasive from the collector outwardly of the drain into the pan.

18 Claims, 3 Drawing Sheets

APPARATUS FOR CATCHING RESIDUAL WATER JET IN WATER JET CUTTING APPARATUS

BACKGROUND OF THE INVENTION

The present invention relates to water jet cutting machines and, more particularly, to such machines having a movable collector for the water jet fluid which may be flushed of abrasive.

It is generally known to catch the residual water jet of a water jet cutting system in a water filled catcher or pan of adequate depth. Line catchers used for this purpose have an effective height which is reduced by a deflecting plate on the bottom of the catcher. A stream of water flows over this deflecting plate and flushes out from the catcher the abrasive and residue cut from the parts (EP 0270364).

Dry catchers filled with balls are also known. Here, the penetrating residual water jet sets the balls in motion and the fluid drains through an opening on the bottom. The drain can also be put on the side of the catcher so that the catcher is being filled with fluid up to the drain. This catcher seems to be less suitable for catching a water jet which utilizes an abrasive (EP 0208038).

A line catcher shown in EP 0319143; it is formed in U-shaped configuration of a flexible material and is placed under the cutting jet and filled with chilled filling material.

Area catchers in pan-form are also known. Above the bottom of the pan, which carries a deflection plate, is a bed of honeycomb material, and tilted deflecting plates are installed under the bed for deflecting or diverting the residual water jet. This dry catcher also seems to be less suitable for working with a water jet to which abrasive has been added (OS 2813498).

It is an object of the present invention to provide a novel water jet cutting machine having a novel moving collector which is readily purged of abrasive and cutting residue.

It is also an object to provide such a machine in which a collector is moved synchronously with the water jet cutting head.

Another object is to provide such a machine in which the water used in the cutting operation is recycled to flush the abrasive into a collection point from which it is transported to a settling tank.

SUMMARY OF THE INVENTION

It has now been found that the foregoing and related objects may be readily attained in a water jet cutting apparatus having a line catcher for water and abrasive passing through the worktable, comprising a frame, a pervious worktable on the frame and a carriage on the frame above the worktable and movable thereover. A water jet cutting head is mounted on the carriage, and a pan is supported on the frame and spaced below the worktable.

A collector extends transversely of the frame and is supported thereon between the worktable and pan for movement along the length of the worktable in alignment with the cutting head. This collector has end, side and bottom walls, and a drain for flow of water and abrasive therefrom and into the pan. An insert member is supported in the collector and has end, side and bottom walls, with the bottom wall being spaced from the bottom wall of the collector and having a drain for flow of water and abrasive therethrough.

The apparatus includes a settling tank, and a sludge pump with a conduit extending from the pan to the settling tank to transport water and abrasive material to the tank. A rinsing pump has a conduit from the settling tank to the collector to draw water from the settling tank and to flush abrasive from the collector outwardly of the drain into the pan.

In the preferred embodiment, the pan is configured to cause water and abrasive material to flow towards a collection area in which the conduit of the sludge pump is disposed. Deflecting material in the insert, and the insert member side walls are spaced from the collector side walls to provide risers therebetween.

Desirably, the cutting head and line catcher are moved synchronously, and sealing elements are provided on the upper end of the insert member to restrict liquid flow sidewise between the insert member and the lower surface of worktable. The worktable is formed as a grid of intersecting vertically disposed strips.

Preferably, the insert member includes inverted L-shaped guides on the upper end of its front and rear walls to define a passage therebetween for flow of the water jet therethrough. The side walls of the insert member and the collector define therebetween vertically extending riser chambers which permit the water to overflow into the pan, and the pan has a trough extending to the collection area. Additionally, a conveyor cooperates with the settling tank to remove the settled abrasive therefrom.

DETAILED DESCRIPTION OF THE PREFERRED EMBODIMENT

Figure 1:
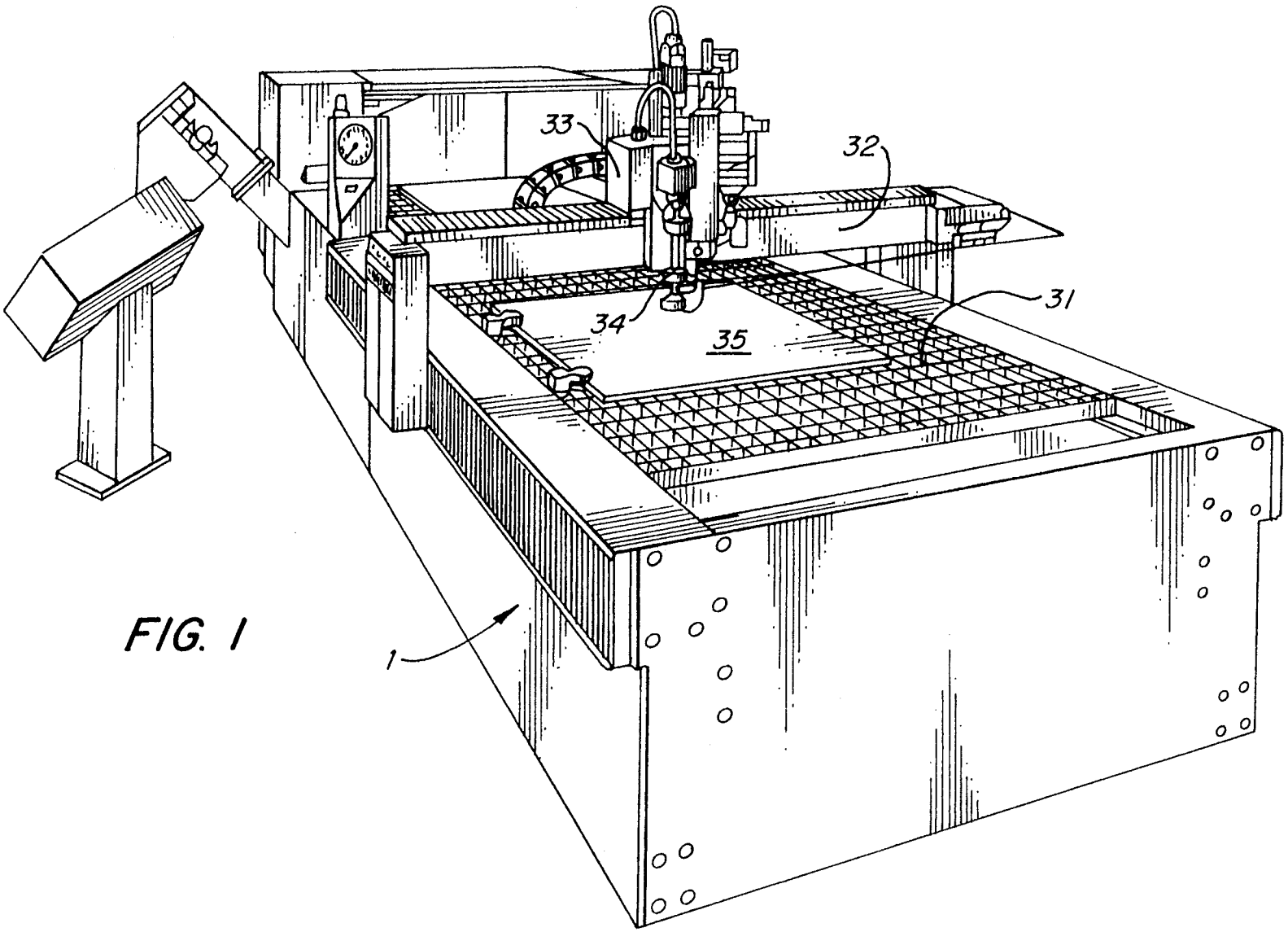
FIG. 1 is a perspective view of a water jet cutting machine embodying the present invention.

Turning first to FIG. 1, therein illustrated is a water jet cutting machine having a frame 1 with a worktable 31 formed by a grid of intersecting, vertically disposed metal strips. Over the machine frame is a movable bridge 32 upon which is movably mounted a carriage 33 which supports the water jet cutting head 34 so that the head 34 can be moved longitudinally and transversely of the worktable 31 to cut a workpiece 35. As is well known, the bridge 32 and carriage 33 are movable in the X and Y axes by drive motors, and the cutting head 34 is movable in the Z axis by a separate drive motor.

Figure 2:
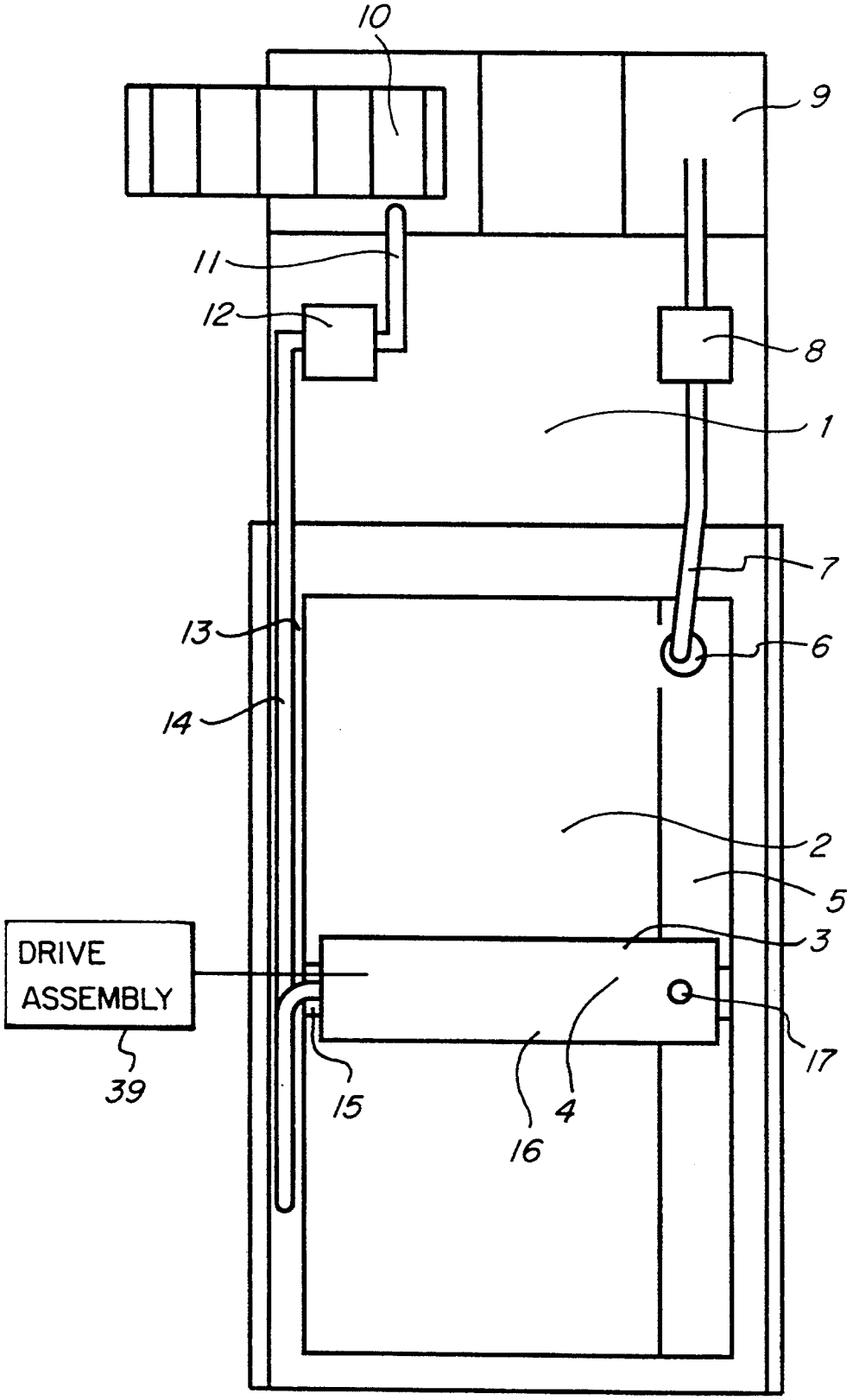
FIG. 2 is a diagrammatic view of the components below the worktable of the machine.

As seen in FIG. 2, in the machine frame or base 1 is a pan 2 over which is disposed a line catcher 4 with a collector 3 which extends across the frame 1 and pan 2. This line catcher 4 can be moved in the longitudinal direction of the pan 2 on rails which are located next to pan 2. The pan 2 is provided with a trough 5 which is tilted towards a collecting area 6. The open end of a suction hose 7 from the sludge pump 8 is put in the collecting area 6.

The sludge pump 8 pumps the abrasive-loaded rinse water from the collecting area 6 into a multi-chamber settling tank 9. In the multi-chamber settling tank 9 is a conveyor belt 10 which conveys from the multi-chamber settling tank 9 the deposited sludge of abrasive and residue from the cutting of parts from the multi-chamber settling tank 9.

The suction line 11 of the pump 12 is connected to the multi-chamber settling tank 9 and its outlet line is a flexible hose 14 which is carried on a support 13 to discharge into the collector 3. In the bottom 16 of the collector 3 is a drain 17 which drains collector 3 through an adjustable opening into the trough 5.

Figure 3:
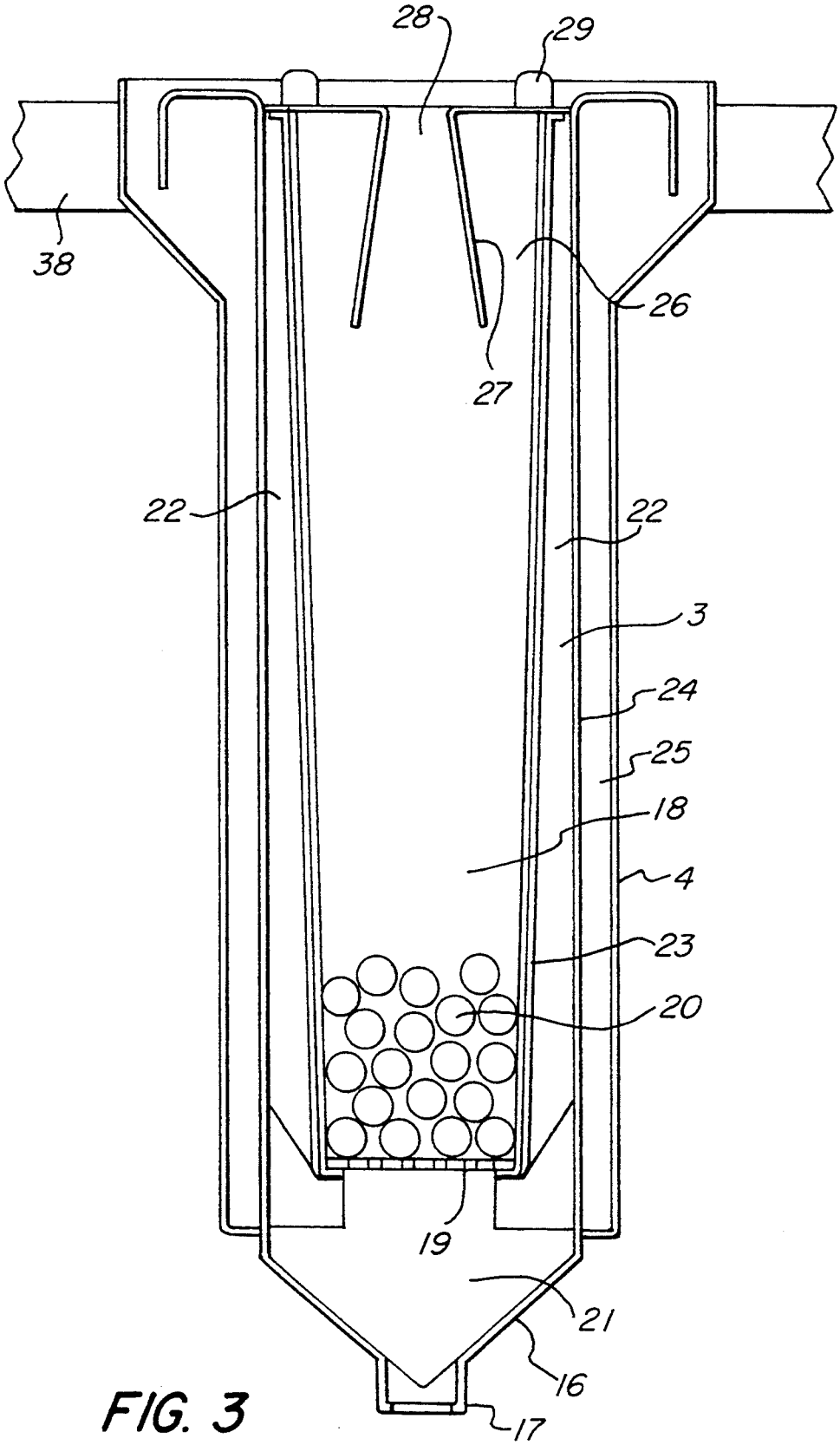
FIG. 3 is a diagrammatic cross sectional view of the collector.

As seen in FIG. 3, the collector 3 has an insert 18 with a perforated bottom wall 19 which is covered with deflecting or baffle material 20 such as metal balls. There is a open space 21 between the perforated bottom wall 19 and the bottom wall 16 of collector 3 through which the rinsing water flows. Adjacent the open space 21 are climbing shafts or risers 22 which are formed by the side walls 23 of the insert 18 and the side walls 24 of collector 3. They lead upwardly to an overflow 25 which allows the water from the line catcher 4 to flow into the pan 2. Inverted L-shaped guides 27 are attached to the upper ends of the elongated side walls 26 of the insert 18, and between the guides 27 is a gap or entry 28. Sealing elements 29 are fastened to the upper surfaces of the guides 27, and they fit closely to the bottom surface of the machine worktable or grid 31.

During an operating cycle, the line catcher 4 is rinsed by rinsing water from the line 14 at a rate which supplies more rinsing water from the pump 12 than is drained through the drain 17. As a result, the insert 18 is filled with rinsing water to the height of overflow 25 outwardly of the guides 27 and it overflows into the pan 2. The sealing elements 29 prevent the water jet from flowing horizontally to the overflow 25 during operation when the water jet passes through the worktable and into the collector 3. The agitated rinse water rises into the chambers formed in the grid of the worktable above the entry point of the water jet, and fills the space of the grid 8. As a result, the noise level caused by the water jet exiting from the workpiece 35 is greatly reduced.

The water jet containing abrasive material enters the water filled insert 18 and its velocity is reduced by the rinse water and the deflecting material 20.

The abrasive material falls through the perforated bottom wall 19 into the open space 21 through which flows the rinsing water, and the abrasive material flushed by the rinsing water flows outwardly of the line catcher 4 into the trough 5 of the pan 2. From the collection area 6, the slurry of water and abrasive material is conveyed to the multi-chamber settling tank 9 by the sludge pump 8 where the abrasive material settles out and the water can be reused for rinsing the line catcher 4.

As previously indicated, the line catcher 4 is movable along the length of the worktable 3 over the pan 2 on rails 38 by a drive assembly 39 in a conventional manner. However, the assembly 39 is operated synchronously with the drive assembly 40 for the bridge 32 so that the gap 28 in the collector 3 is aligned directly below the cutting head 34.

Thus, it can be seen from the foregoing detailed description and attached drawings that the water jet cutting machine of the present invention collects the water jet and abrasive material efficiently and rinses the abrasive material from the collector with recycled water. The abrasive material rinsed automatically and continuously, and the water in the catcher fills the grid of the worktable to reduce the noise of operation. The line catcher can be fabricated readily and relatively economically.

Having thus described the invention, what is claimed is:

1. A water jet cutting apparatus having a line catcher for water and abrasive passing through the worktable, comprising:

(a) a frame;

(b) a pervious worktable on the frame;

(c) a carriage on said frame above said worktable and movable thereover;

(d) a water jet cutting head on said carriage;

(e) a pan supported on said frame and spaced below said worktable;

(f) a collector extending transversely of the frame and supported thereon between said worktable and pan for movement along the length of said worktable in alignment with said cutting head, said collector having end, side and bottom walls, said collector having a drain for flow of water and abrasive therefrom and into said pan;

(g) an insert member of generally polygonal cross section supported in said collector and having end, side and bottom walls, said bottom wall being spaced from said bottom wall of said collector and having a drain for flow of water and abrasive therethrough;

(h) a settling tank;

(i) a sludge pump with a conduit from said pan to said settling tank to transport water and abrasive material to said tank; and (j) a rinsing pump having a conduit from said settling tank to said collector to draw water substantially free from abrasive from the top of said settling tank and to pump the water to said collector to flush abrasive from said collector outwardly of said drain into said pan.

2. The water jet cutting apparatus of claim 1 wherein said pan is configured to cause water and abrasive material to flow towards a collection area in which said conduit of said sludge pump is disposed.

3. The water jet cutting apparatus of claim 1 wherein there is included deflecting material in said insert member.

4. The water jet cutting apparatus of claim 1 wherein said insert member side walls are spaced from said collector side walls to provide risers therebetween.

5. The water jet cutting apparatus of claim 1 wherein said cutting head and line catcher are moved synchronously.

6. The water jet cutting apparatus in accordance with claim 1 wherein sealing elements are provided on the upper end of said insert member to restrict liquid flow sidewise between said insert member and the lower surface of said worktable.

7. The water jet cutting apparatus in accordance with claim 1 wherein said worktable is formed as a grid of intersecting vertically disposed strips.

8. The water jet cutting apparatus in accordance with claim 1 wherein said insert member includes inverted L-shaped guides on the upper end of its end walls to define a passage therebetween for flow of the water jet therethrough.

9. The water jet cutting apparatus in accordance with claim 8 wherein sealing elements are provided on the upper end of said L-shaped guides to restrict liquid flow sidewise between said insert member and the lower surface of said worktable.

10. The water jet cutting apparatus in accordance with claim 1 wherein said side walls of said insert member and said collector define therebetween vertically extending riser chambers which permit the water to overflow into said pan.

11. The water jet cutting apparatus in accordance with claim 1 wherein said pan has a trough extending to said collection area.

12. The water jet cutting apparatus in accordance with claim 1 wherein there is included a conveyor cooperating with said settling tank to remove the settled abrasive therefrom.

13. A water jet cutting apparatus having a line catcher for water and abrasive passing through the worktable, comprising:

(a) a frame;

(b) a pervious worktable on the frame;

(c) a carriage on said frame above said worktable and movable thereover;

(d) a water jet cutting head on said carriage;

(e) a pan supported on said frame and spaced below said worktable, said pan being configured to cause water and abrasive material to flow towards a collection area;

(f) a collector extending transversely of the frame and supported thereon between said worktable and pan for movement along the length of said worktable in alignment with said cutting head, said collector having end, side and bottom walls, said collector having a drain for flow of water and abrasive therefrom and into said pan, said cutting head and line catcher being moved synchronously;

(g) an insert member supported in said collector and having a polygonal cross section with end, side and bottom walls, said bottom wall being spaced from said bottom wall of said collector and having a drain for flow of water and abrasive therethrough;

(h) deflecting material in said insert member;

(i) a settling tank;

(j) a sludge pump with a conduit from said collection area of said pan to said settling tank to transport water and abrasive material to said tank; and (k) a rinsing pump having a conduit from said settling tank to said collector to draw water from said settling tank and to pump the water to said collector to flush abrasive from said collector outwardly of said drain into said pan.

14. The water jet cutting apparatus of claim 13 wherein said insert member side walls are spaced from said collector side walls to provide risers therebetween.

15. The water jet cutting apparatus in accordance with claim 13 wherein sealing elements are provided on the upper end of said insert member to restrict liquid flow between said insert member and the lower surface of worktable.

16. The water jet cutting apparatus in accordance with claim 13 wherein said worktable is formed as a grid of intersecting vertically disposed strips.

17. The water jet cutting apparatus in accordance with claim 13 wherein said insert member includes inverted L-shaped guides on the upper end of its front and rear walls to define a passage therebetween for flow of the water jet therethrough, said side walls of said insert member and said collector defining therebetween vertically extending riser chambers which permit the water to overflow into said pan.

18. The water jet cutting apparatus in accordance with claim 13 wherein there is included a conveyor cooperating with said settling tank to remove the settled abrasive therefrom.

* * * * *